US005956842A

United States Patent [19]

Stewart

[11] Patent Number: 5,956,842

[45] Date of Patent: Sep. 28, 1999

[54] BUTT AND THIMBLE PRESS

[75] Inventor: Karl Stewart, King Lake West, Australia

[73] Assignee: Comalco Aluminium Limited, Melbourne, Australia

[21] Appl. No.: 08/875,610

[22] PCT Filed: Feb. 13, 1996

[86] PCT No.: PCT/AU96/00072

§ 371 Date: Oct. 31, 1997

§ 102(e) Date: Oct. 31, 1997

[87] PCT Pub. No.: WO96/25536

PCT Pub. Date: Aug. 22, 1996

[30] Foreign Application Priority Data

Feb. 14, 1995 [AU] Australia ..... PN1111

[51] Int. Cl.[6] ..... H01R 43/00

[52] U.S. Cl. ..... 29/825; 204/245; 204/247.2; 205/389

[58] Field of Search ..... 29/825; 204/245, 204/247.2; 205/389

[56] References Cited

U.S. PATENT DOCUMENTS 4,119,505 10/1978 Baillot et al. .
4,510,033 4/1985 Martin et al. .
4,514,873 5/1985 Golla .
4,701,249 10/1987 Wisniewski et al. .

FOREIGN PATENT DOCUMENTS 191954 8/1986 European Pat. Off. .
2100754 1/1983 United Kingdom .

*Primary Examiner*—Carl J. Arbes
*Attorney, Agent, or Firm*—Dennison, Meserole, Scheiner & Schultz

[57] ABSTRACT

An apparatus for breaking the anode butt (15) and stripping the thimbles (13) from the yoke stubs (12) of an anode. The apparatus includes a support frame (20), a fixed plate assembly (21) secured to the supporting frame (20) and a ram assembly (22) extendible towards the fixed plate assembly (21). The fixed plate assembly (21) comprises a substantially rigid fixed plate (23) having recesses (24*a*) to receive the yoke (11) and yoke stubs (12). The recesses (24*a*) are shaped such that the thimbles (13) on the yoke stubs (12) of the anode butt (15) abut against the fixed plate assembly (21) during the extension of the ram assembly (22) to contact and break the anode butt. The fixed plate assembly (21) may be provided with a stub locating mechanism which locates the stubs in position and abuts against the thimbles (13) on the stubs (12) during the extension of the ram assembly (22). The stub locating mechanism also abuts against and is supported by the substantially rigid fixed plate (23).

29 Claims, 11 Drawing Sheets

BUTT AND THIMBLE PRESS

BACKGROUND OF THE INVENTION

This invention relates to a method and apparatus for the removal of anode butts or anode remnants and stripping thimbles from anodes such as those used in the electrolytic smelting of aluminiums.

In the electrolytic smelting of metals such as aluminium, the cathode is located in the bottom and lower side regions of the cell and a carbon anode block is suspended or supported by yoke stubs attached to the anode rod. The yoke stubs have cast iron thimbles fitted at their lowermost end and the thimbles are cast within recesses in the carbon anode block. During operation of the smelting cell the carbon anode is consumed requiring regular replacement of the anode block.

To replace the anode block, it is necessary to remove the anode remnants or butts and the cast iron thimbles from the anode yoke stubs. For the economics of the smelting operation, it is highly desirable that the anode butts are removed, crushed and the carbon reclaimed for use in replacement carbon anode blocks.

In the prior art, the thimbles and anode butts are removed by a downwardly acting stripper. Since the main support for the anode rod and anode butt is the overhead transport crane; additional clamping device have been employed to resist the downward forces required to strip the anode butt and thimble from the anode yoke stubs.

In GB 1269809, an anode stripping apparatus is disclosed in which the anode rod is clamped in a clamping device consisting of two hydraulically operated pistons. Hydraulic strippers act vertically downwardly on the anode butt to strip the butt from the stub. Scrappers are provided on the downwardly acting strippers to remove the thimble from the stub.

During the downward operation of the stripper, the anode rod is held in position and supported by the clamping device acting laterally on the rod. Since a large force needs to be applied by the clamping device to resist the downward forces of the stripper, damage to the anode rod and a shortened operating life is inevitable.

The apparatus as disclosed in EP 191,954 and U.S. Pat. No. 4,442,593 also rely on downwardly acting hydraulic rams to break the anode butt from the anode stub.

Australian Patent No. 565330 and GB 2,108,530 relate to holding device for an anode stub to secure the anode in position during cleaning of the anode.

In other prior art methods, the steps of anode block removal and thimble stripping have been carried out in separate operations, on separate apparatus and at separate locations thereby increasing the space required for the operations and the capital cost of equipment.

BRIEF SUMMARY OF THE INVENTION

It is an object of the present invention to provide an apparatus and method for the removal of the anode butt and thimble from the anode yoke stab without some of the problems of the prior art.

The invention provides an apparatus for breaking the anode butt and stripping the thimbles from the stubs of an anode including a support frame, a fixed plate assembly substantially secured to said support frame, and a ram assembly extendible towards said fixed plate assembly for contacting and breaking the anode butt and stripping the thimbles, said fixed plate assembly comprising a substantially rigid fixed plate and having recesses to receive the anode stubs of said anode, said thimbles abutting said fixed plate assembly during the extension of said ram assembly to contact and break said anode butt.

By securing the substantially rigid fixed plate to the support frame in line with the ram assembly, the fixed plate becomes the load bearing surface and, substantially all of the loads applied by said ram assembly are transferred to the fixed plate and support frame during the breaking and stripping operation.

The ram assembly may comprise an hydraulic ram with stripping means to protrude into the anode butt during the movement of the hydraulic ram and thereby break the anode butt. The stripping means is preferably also able to strip the thimbles from the yoke stub after the bulk of the anode butt has been removed from the thimbles. Preferably the stripping means are rock bits mounted on a platen attached to the uppermost surface of the ram.

The apparatus may be also include locating means which aligns the anode stubs with the recesses in the rigid fixed plate. The locating means are preferably opposed locating arms positioned in line with the fixed plate assembly and the ram assembly.

In a preferred form of the invention, the ram assembly is positioned below the fixed plate assembly and the breaking and stripping operation is performed by upward movement of the hydraulic ram towards the fixed plate assembly.

The substantially rigid fixed plate is preferably provided with an aperture to separate the fixed plate assembly and fixed plate into two sections. When the anode butt is moved into position between the fixed plate assembly and the ram assembly, the anode stem passes through the aperture until the stubs are aligned wit the recesses in the fixed plate.

The recess in the fixed plate are sized to enable the stripped stubs to pass therethrough but sufficiently small to prevent the passage of the thimbles. Therefore, if the relative positions of the stubs on the anode yoke remain substantially constant, the size and shape of the recesses will allow the thimbles to abut directly onto the fixed plate to transfer the load from the ram assembly to the support frame.

In operational situations, a number of anodes are used and maintained and there may often be variations in the relative position of the anode stubs on each of the anode yokes. In these situations where the variations are considered large, the size and shape of the recesses required to enable the stripped stubs of the anodes to pass vertically through the fixed plate may result in only a small portion of the top flange of the thimble contacting or overlapping the bottom of the fixed plate. Consequently accurate locating of the stubs relative to the fixed plate may be required.

The fixed plate assembly may further comprise a stub locating mechanism. The stub locating mechanism may be either a clamp or claw assembly which secures the yoke stub in position minimizing lateral movement of the anode relative to the fixed plate.

In another aspect of the invention, there is provided a method for the removal of an anode butt and thimbles from the stubs of an anode yoke of an anode on an apparatus including a fixed plate assembly having a substantially rigid apertured fixed plate and an ram assembly for contacting and breaking said anode butt, said method including the steps of positioning the anode butt between the fixed plate assembly and the ram assembly, moving the anode to receive the anode stubs within recesses in the fixed plate, extending the ram assembly towards the fixed plate to contact and break the anode butt against the fixed plate assembly and strip the thimbles from the anode stubs, retracting the ram assembly and withdrawing the stripped anode from the fixed plate assembly.

The step of extending the ram assembly may further comprise the steps of initially, extending the ram assembly to contact and break the anode butt, retracting the ram assembly to allow the larger pieces of the butt to be cleared, and extending the ram assembly to strip the thimbles and remaining anode pieces from the anode butts.

The ram assembly may be provided with a stripping means to protrude into the anode butt during the breaking operation. The stripping means which is preferably in the form of rock bits mounted on a platen attached to the ram, is able to strip the thimble from the yoke stub to allow it to be removed.

The step of positioning the anode between the fixed plate assembly and the ram assembly may also include an additional step of locating the anode rod using a locating means. Once the anode has been moved into position and the stubs are received within the recesses of the fixed plate, a stub locating mechanism may be activated to locate the stubs in position such that the respective thimbles are positioned relative to the recesses to upward movement of the thimbles beyond the fixed place.

Movement of the ram assembly towards the fixed plate assembly ensures that substantially all of the load from the hydraulic ram is transferred to the substantially rigid support plate during the butt breaking and thimble stripping operation.

DETAILED DESCRIPTION OF THE PREFERRED EMBODIMENT

Figure 1:
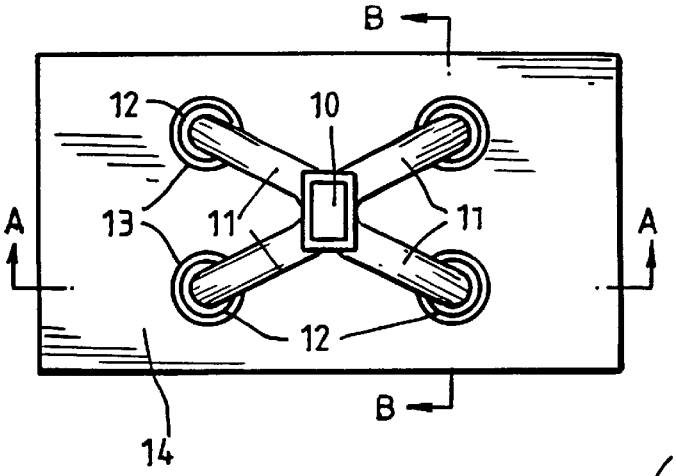
FIG. 1 is a plan view of a typical anode used in the invention.
Figure 4:
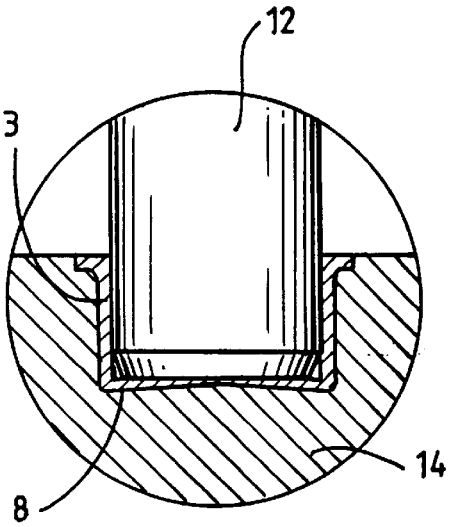
FIG. 4 is an enlarged view of region C of FIG. 2.
Figure 2:
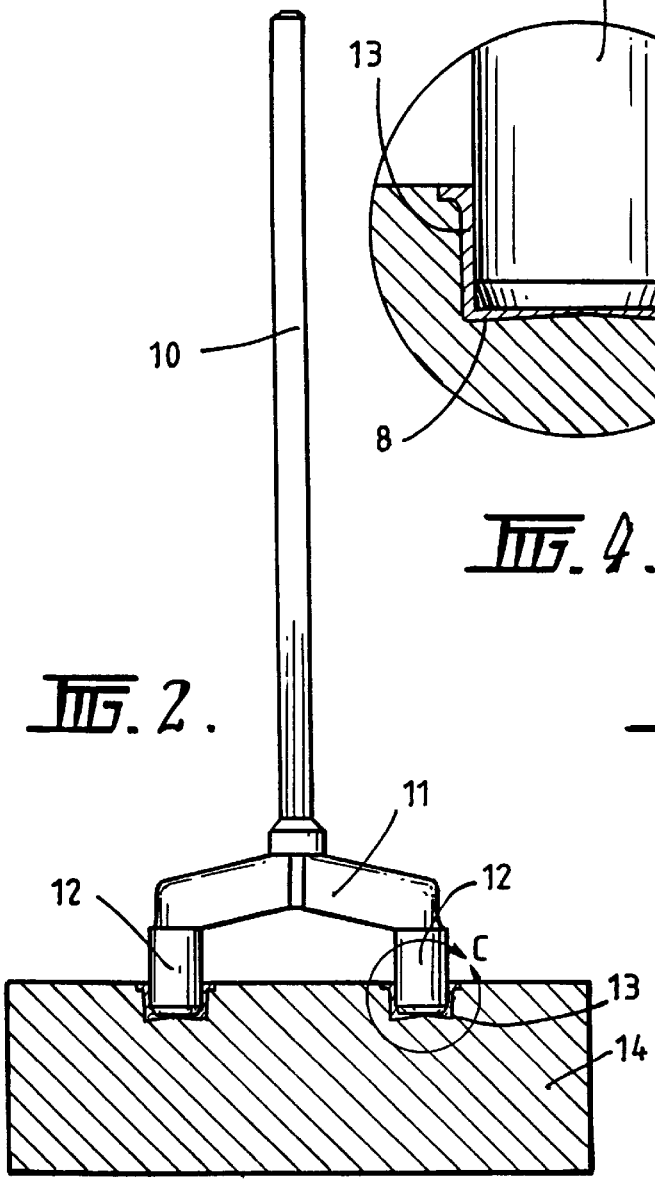
FIG. 2 is a sectional view through line A—A of FIG. 1.
Figure 3:
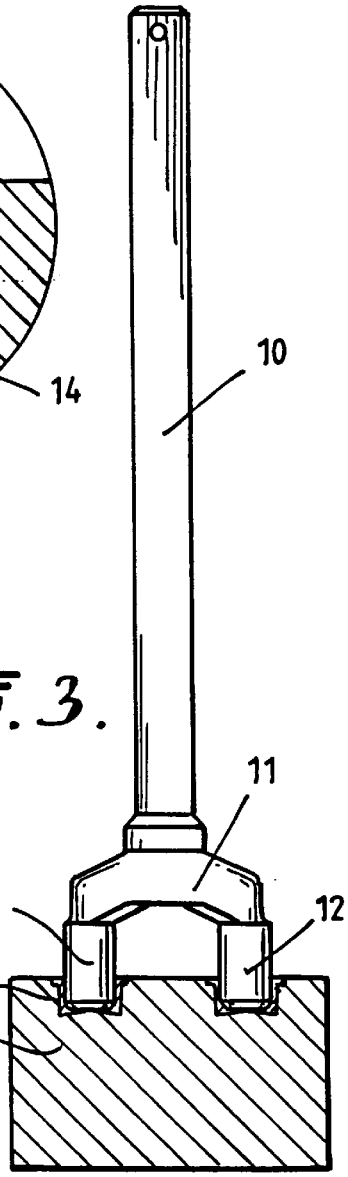
FIG. 3 is a sectional view through line B—B of FIG. 1.

While the invention will be described with reference to four stub anode yokes, it would be appreciated by those skilled in the art that the apparatus and method can easily be adapted to anode yokes with a different number of stubs (such as 2, 3, 6 or 8 stub yokes) which can be found in the industry by increasing or decreasing the number of rock bits (to correspond with the number of stubs) and making other minor non-inventive modifications.

Referring to FIGS. 1, 2, 3 and 4, a typical anode for use with the apparatus and method of the invention as shown. The anode consists of an anode rod or stem 10 connected to a yoke 11. The yoke stub 12 of the yoke 11 is fitted with thimbles 13 which are received within wells 8 formed within the upper surface of a carbon anode block 14. The anode rod 10 is coupled overhead to a conveyer for transport around the rodding room (not shown).

While the apparatus in accordance with an embodiment of the invention will now be described with regard to an upwardly acting ram assembly and a substantially vertically aligned anode rod, it would be appreciated by those skilled in the art that other alignments of the ram assembly and anode rod (e.g. horizontal) can be assumed without departing from the scope of the invention.

Figure 5:
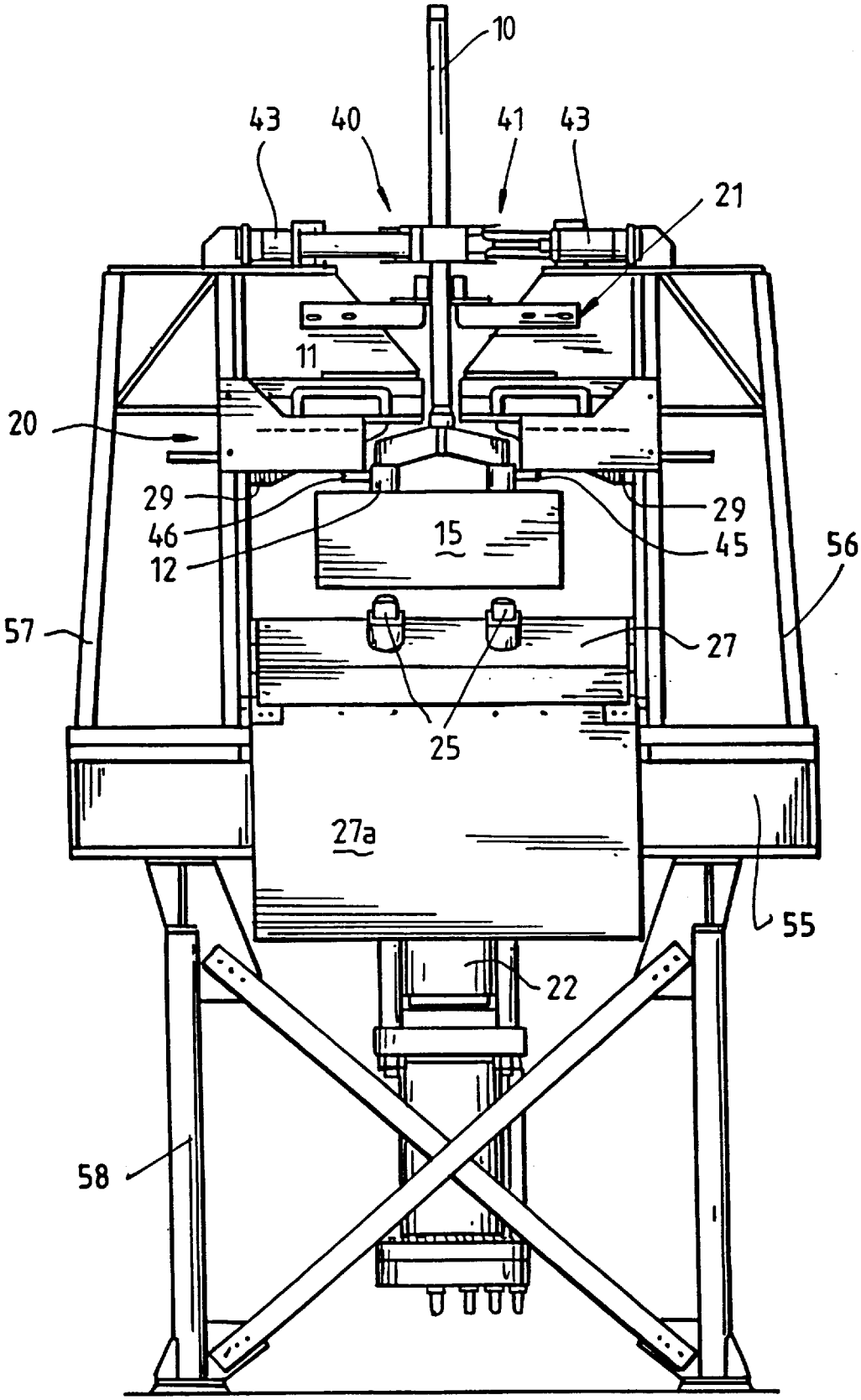
FIG. 5 is an elevational view of an embodiment of the apparatus of the invention.
Figure 6:
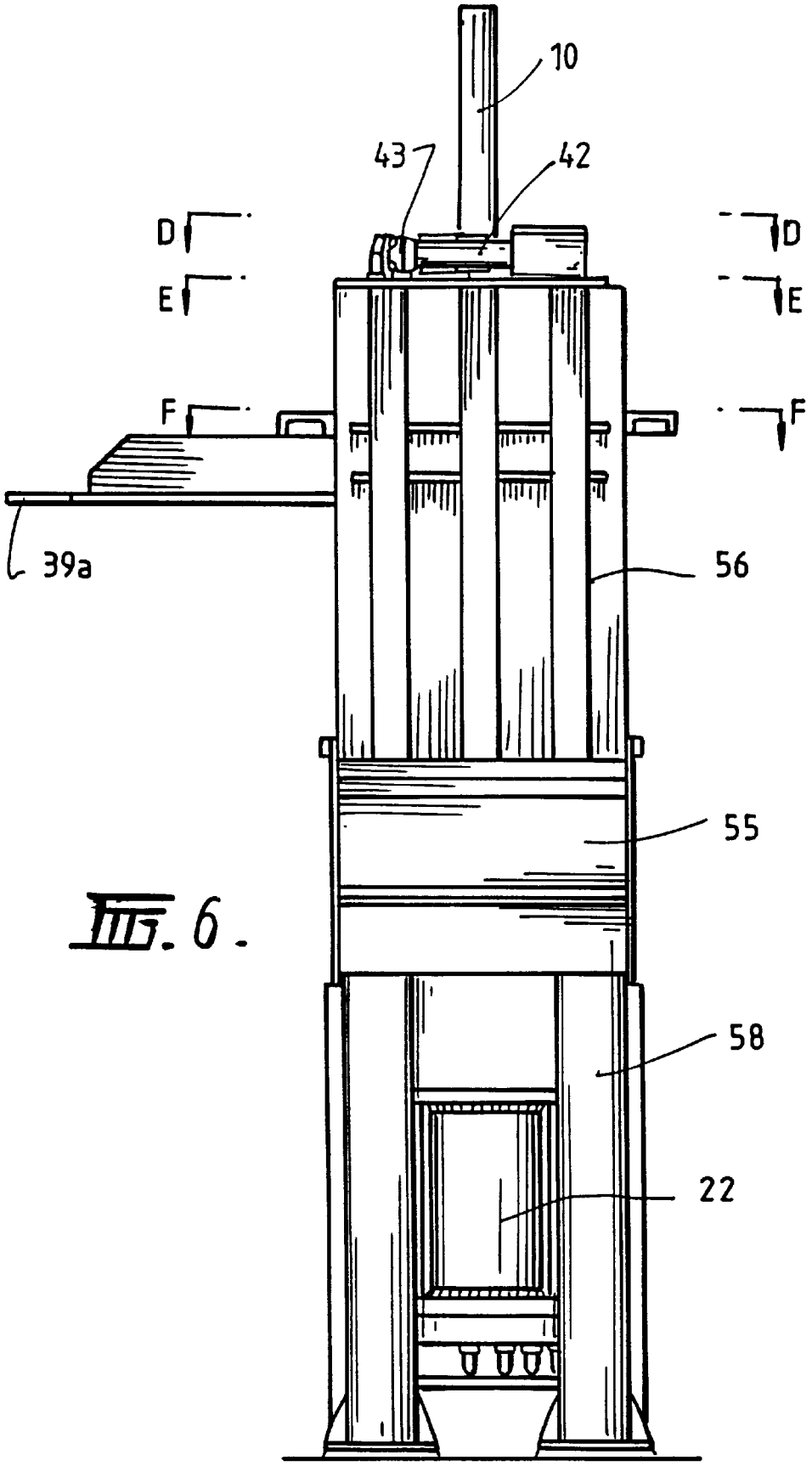
FIG. 6 is a side view of the embodiment shown in FIG. 5.
Figure 9:
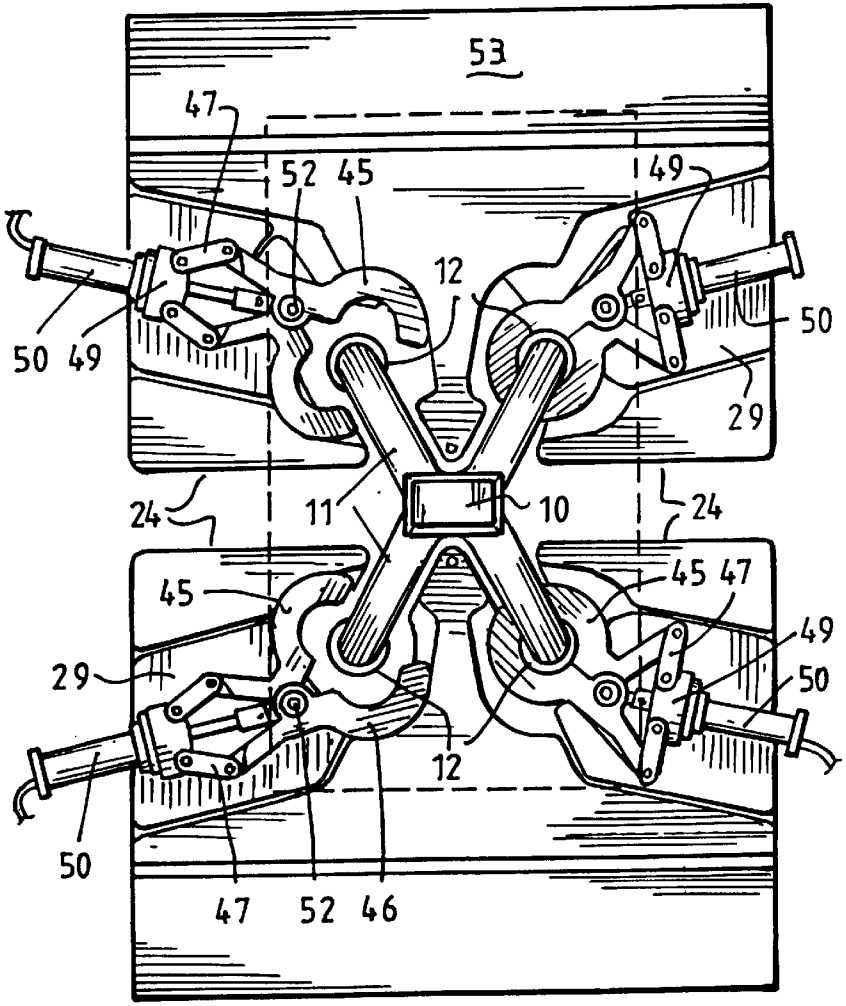
FIG. 9 is a sectional view of the embodiment of FIG. 6 through line F—F of FIG. 6.

The apparatus shown in FIGS. 5 and 6 for removing the anode carbon butt 15 and thimble 13 from the yoke stubs 12 includes a support frame 20 to which is substantially secured to a fixed plate assembly 21 and further includes an upwardly acting hydraulic ram assembly 22 for contacting and breaking the anode butt 15 and stripping the thimbles 13.

Figure 8:
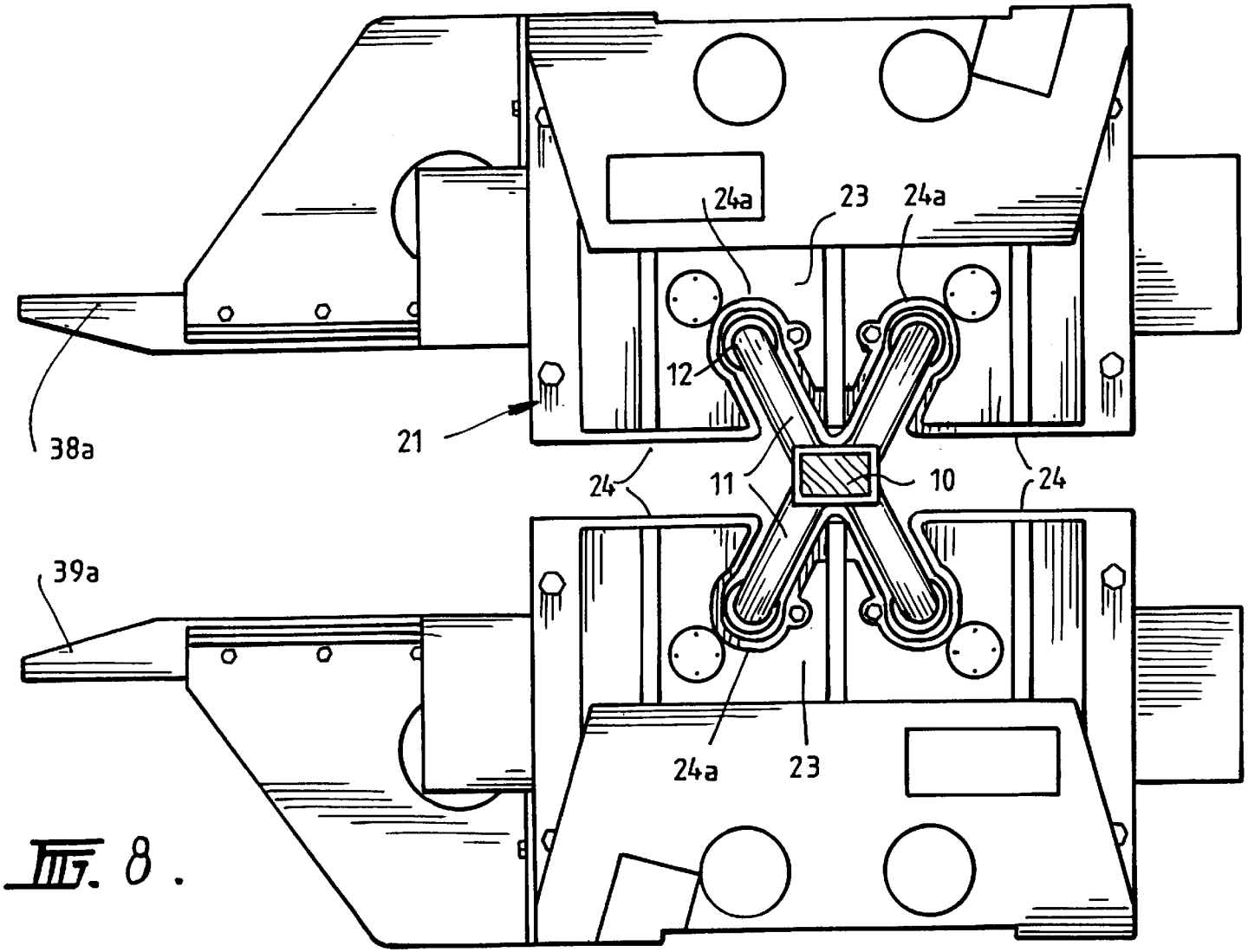
FIG. 8 is a sectional view of the embodiment of FIG. 6 through line E—E of FIG. 6.

The fixed plate assembly 21 shown in FIG. 8 includes a substantially rigid fixed plate 23 having an aperture 24 to capable the anode butt to be positioned between the fixed plate assembly and the ram assembly and recesses 24*a* to receive the yoke 11 and yoke stubs 12 of the anode. The aperture in the fixed plate 23 preferably separates the fixed plate assembly 21 and fixed plate 23 into two sections. When the anode yoke is move horizontally into position beneath the fixed plate assembly 23, the anode stem 10 passes through the aperture 24 until the stubs 12 are below the recesses 24*a* in the fixed plate. The size and shape of the recesses 24*a* are such that the stripped anode butts are able to pass vertically through the fixed plate 23 but prevent upward movement of the thimbles beyond the fixed plate 23. In this way, the force applied to the anode by the ram assembly during the action of breaking the butt and stripping the thimbles is transferred directly to the fixed plate 23. The fixed plate is rigidly secured to the support frame 20 to provide adequate resistance to those forces.

Figure 7:
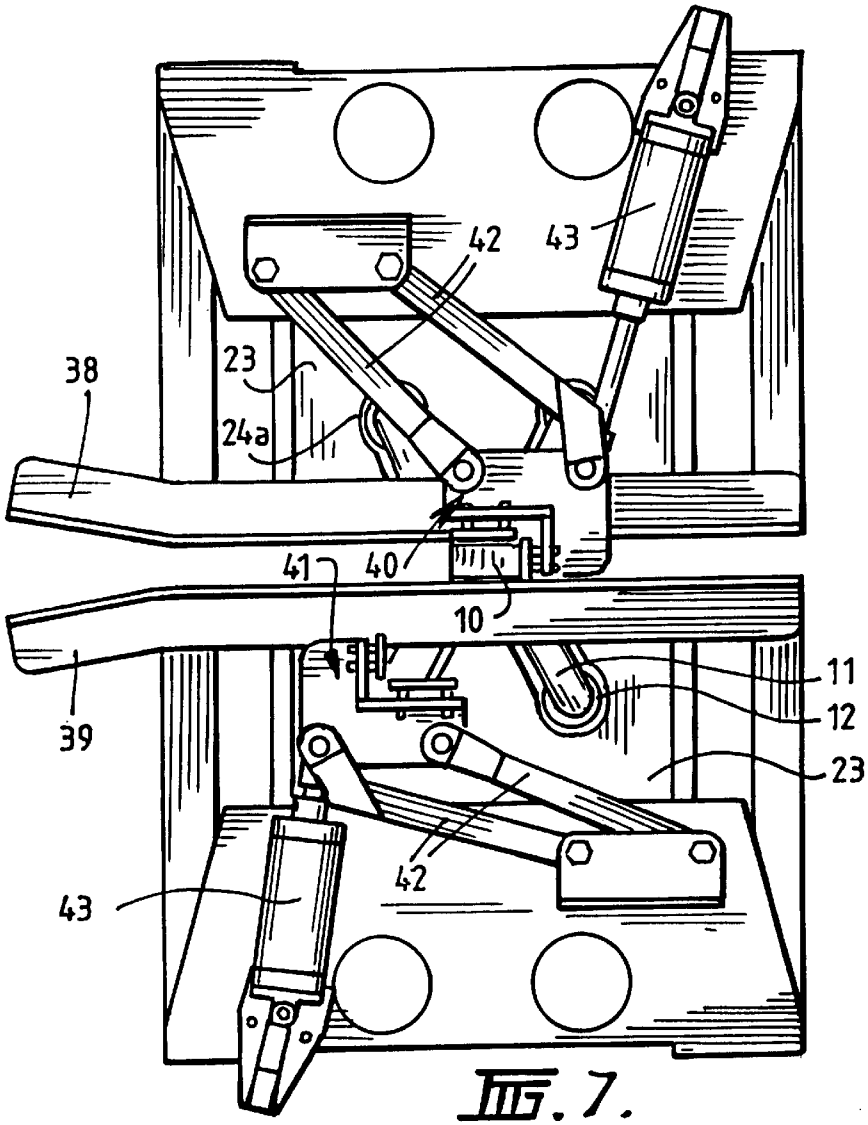
FIG. 7 is a sectional view of the embodiment of FIG. 6 through line D—D of FIG. 6.
Figure 22:
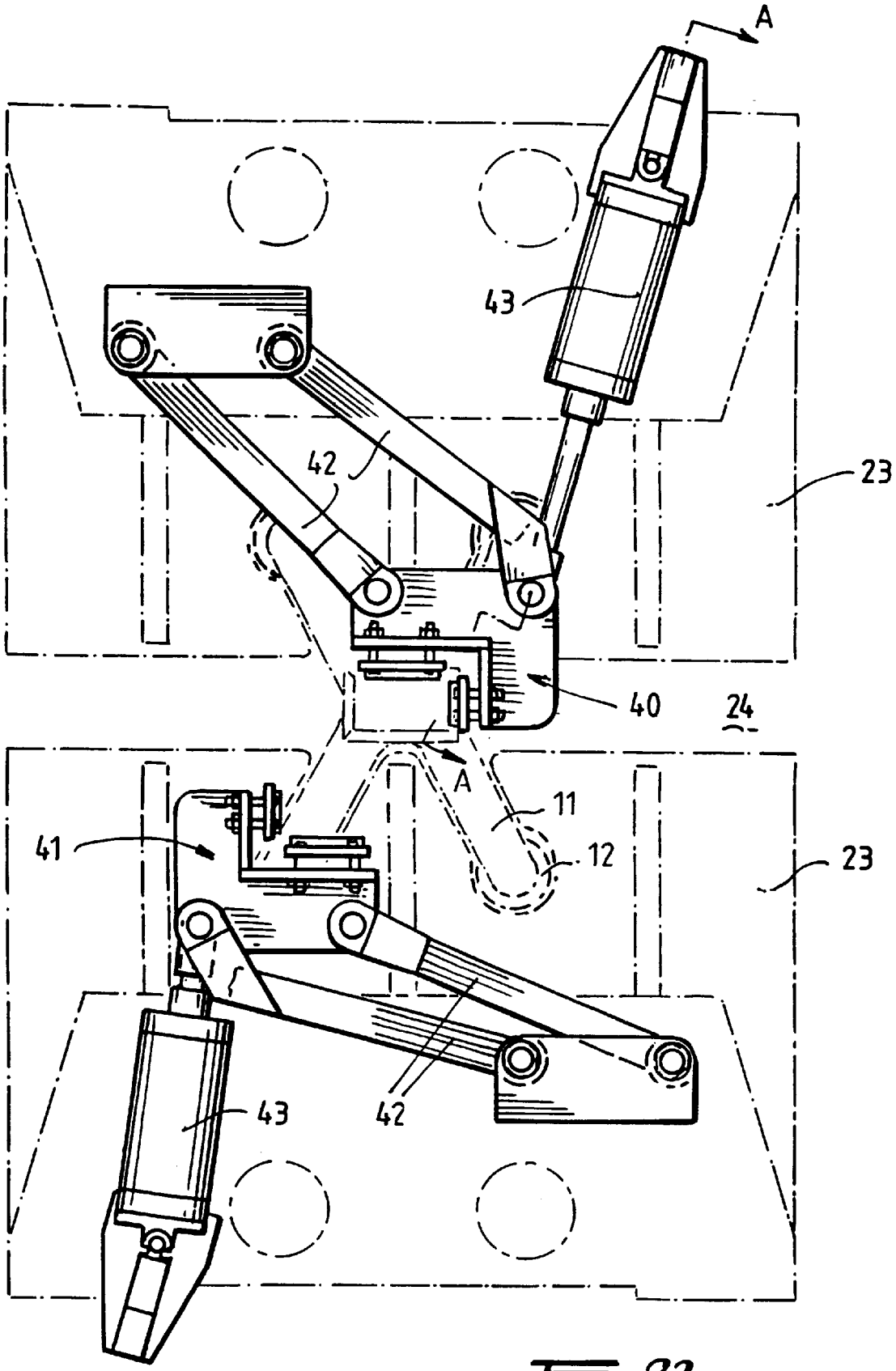
FIG. 22 is a plan view of the anode rod locating means.

When the anode reaches the apparatus in accordance with the embodiment of the invention, the anode rod is moved into the aperture 24 along guide rails 38, 39 and preferably located in position by means of an overhead locating means shown in FIGS. 7 and 22. Stub guides 38*a* and 39*a* are also provided to assist positioning of the anode. The locating means comprises two stops 40, 41 which separately engage the anode rod 10. The two stops are each pivotally mounted on swing arms 42 and pivotally mounted air rams 43 are provided to control the position thereof.

The anode is lifted into position by a lifting assembly (not shown) such that the anode stubs are received within the recesses 24*a* in the rigid fixed plate 23.

Figure 10:
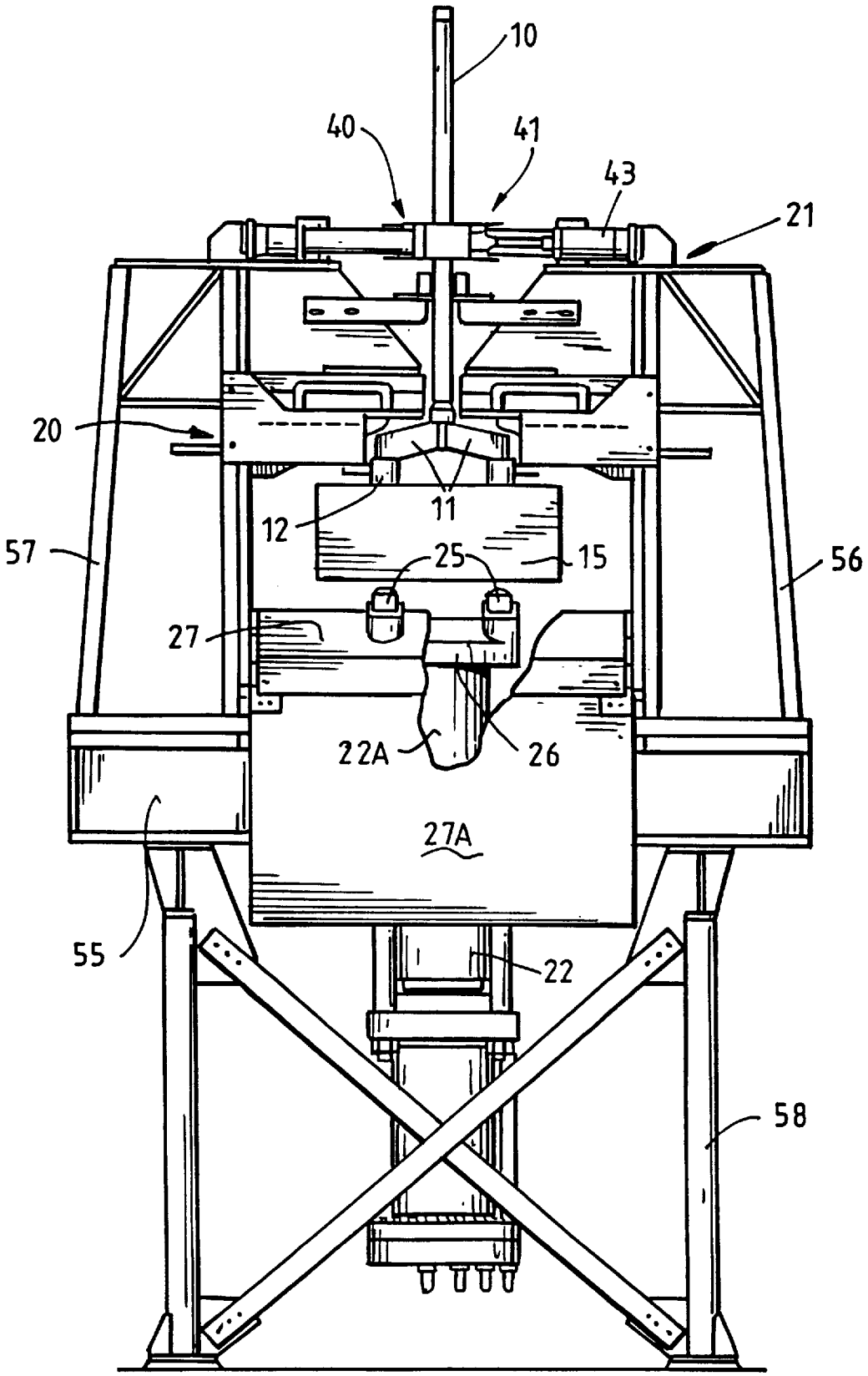
FIG. 10 is an elevational view of an embodiment of FIG. 5 with a section of the shedder plate removed.

To facilitate the breaking of the butt 15 and stripping of the thimbles 13, the hydraulic ram assembly 22 shown in FIG. 5 is preferably provided with stripping means illustrated as rock bits 25 mounted on a stripper plate 26. The number of rock bits equates with the number of yoke stubs an thimbles. These rock bits 25 penetrate into the anode butt 15 during the upward movement of the hydraulic ram to split the butt. The rock bits 25 are positioned on a stripper platen 26 (shown in FIG. 10) so that upward movement of the ram assembly 22 will fracture the carbon butt 15 and bring the rock bits 25 into contact with the thimbles 13 to crush the bottom of the thimble. Further application of the load strips the thimble from the yoke stubs 12 enabling the thimbles to fall away. The rock bits are preferably provided with knife edges to aid crack propagation in the wall of the thimble.

A shedder plate 27 shown in FIG. 5, is mounted to the stripper platen 26 and is apertured to allow the rock bits 25 to protrude through its upper surface. The shedder plate 27 moves vertically with the extension of the hydraulic ram cylinder 22A. The purpose of the shedder plate 27 is to deflect pieces of the broken anode butt to either side of the ram to be collected in conveyors (not shown) which convey the pieces of anode butt and split thimbles away from the apparatus.

A fixed shedder plate 27A may also be provided fixed to the hydraulic cylinder of the ram assembly to cover the cylinder at all times. The angle of the shedder plate and fixed shedder plate to the horizontal is sufficient to shed the broken butts and thimbles and would typically range between 30°–60° depending on the anticipated sizes of the broken butts. A cylinder bellows connected to the underside of the moving shedder plate and to the top of the cylinder flange may be provided to protect the cylinder from particles scoring the hydraulic ram rod.

The shedder plate 27 is preferably arranged across the narrow side of the machine to minimize the height lost by the broken butts and thimble pieces as they clear the apparatus. The broken butts and thimble pieces are then conveyed away from the apparatus.

Figure 11:
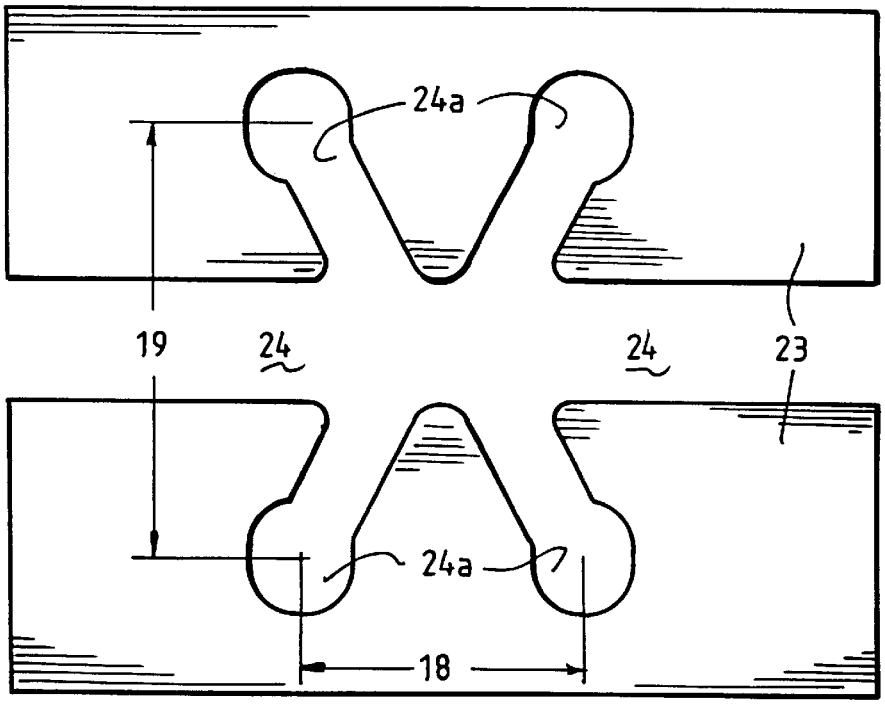
FIG. 11 is a plan view of the fixed plate showing the arrangement of recesses for a four stub yoke.

Referring to FIG. 11, the distances 18, 19 between the centres of the recesses 24*a* in the fixed plate 23 are substantially the same as the respective average distances between the centres of the stubs 12 of the anode yoke 11.

Figure 12:
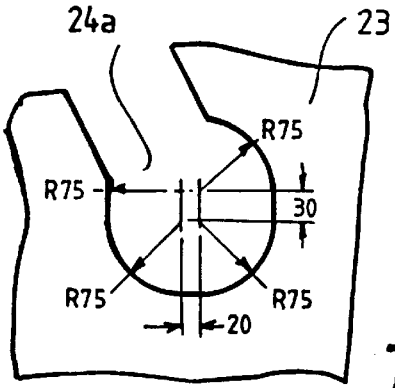
FIG. 12 is schematic view showing an example of the shape of a recess in the fixed plate.

The recesses 24*a* in the fixed plate 23 are shaped and sized to enable the stripped stubs to pass vertically therethrough but sufficiently small to prevent the passage of the thimbles. An example of the shape of a recess is shown in FIG. 12.

In an operational situation, a number of anode rods are used to enable fresh anodes to be installed into the smelting pot while the butt and thimbles are stripped from the rods of the used anodes.

Where the relative positions of the anode stubs on the anode yoke remain substantially constant, the size and shape of the recess 24*a* are designed to enable a high proportion of the upper flange 16 of the thimble to abut against the fixed plate 23 and transfer the load from the ram assembly 22 directly to the fixed plate 23.

In many operations and in particular older operations, there may often be variations in the relative position of the anode stubs on each of the anode yokes in operation. Where the variations are considered large, the size and shape of the recesses required to enable the stripped stubs 12 of the anodes to pass vertically through the fixed plate 23 may result in only a small portion of the top flange 16 of the thimble 13 overlapping with the bottom of the fixed plate 23. Consequently a stub locating mechanism may be provided on the fixed plate assembly 21 to position the stubs 12 relative to the fixed plate 23 and ensure that the load from the hydraulic ram assembly is transferred through the thimbles to the fixed plate 23.

The stub locating mechanism which may be in the form of either a clamp or claw assembly which positions the yoke stub 12 prior to the breaking and stripping operation. The clamp or claw assembly is preferably secured between a bottom plate 29 and the fixed plate 23.

Figure 14:
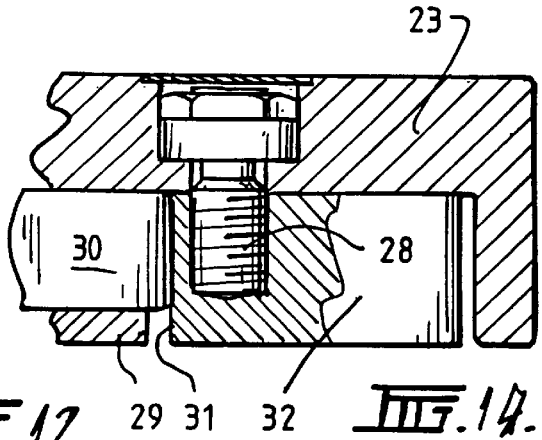
FIG. 14 is a sectional view of an embodiment of the clamp mechanism positioned in the fixed plate.
Figure 15:
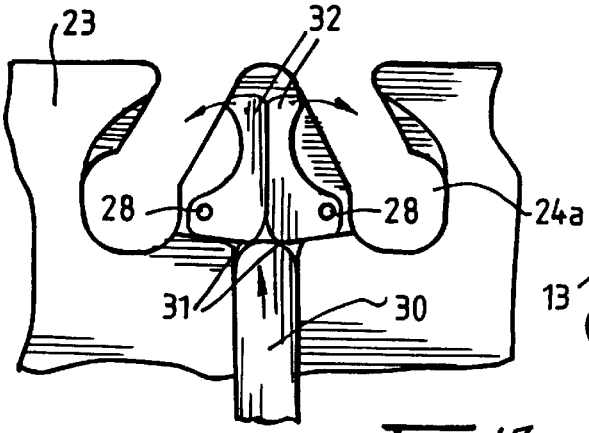
FIG. 15 is a plan view of the clamp mechanism in the open position.
Figure 16:
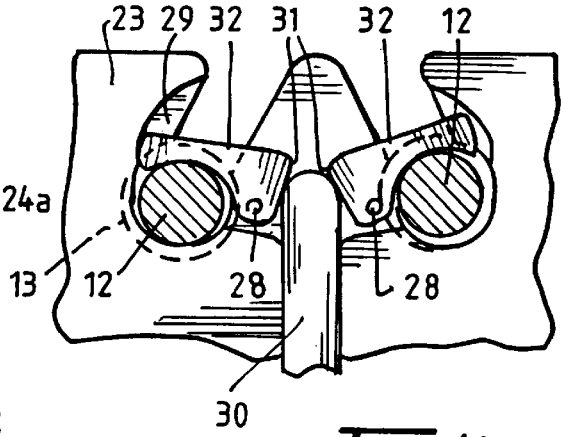
FIG. 16 is a plan view of the clamp mechanism in the closed position.
Figure 13:
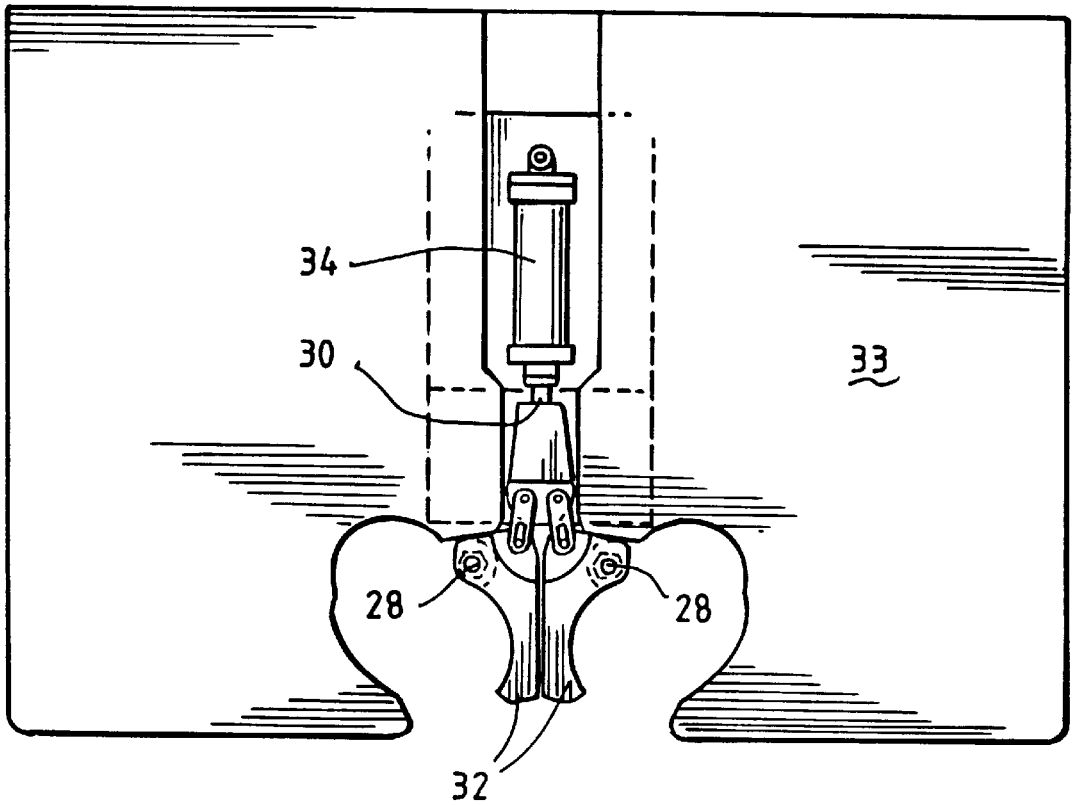
FIG. 13 is a plan view of a clamp assembly.
Figure 13:
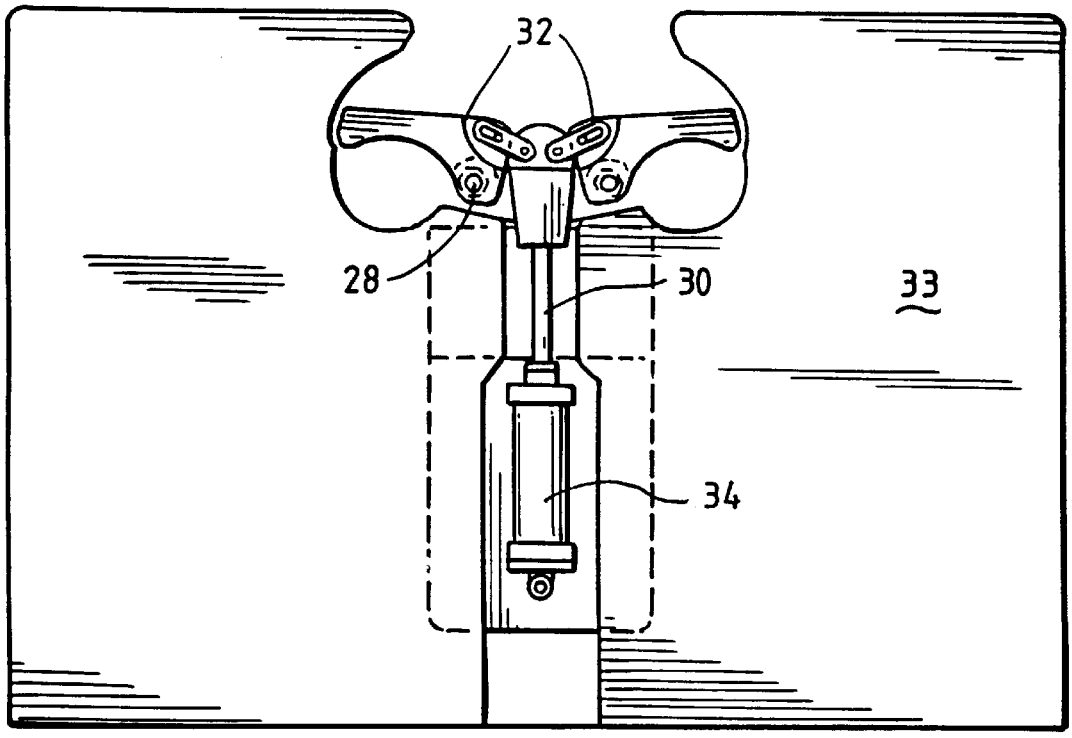
Figures 17, 18:
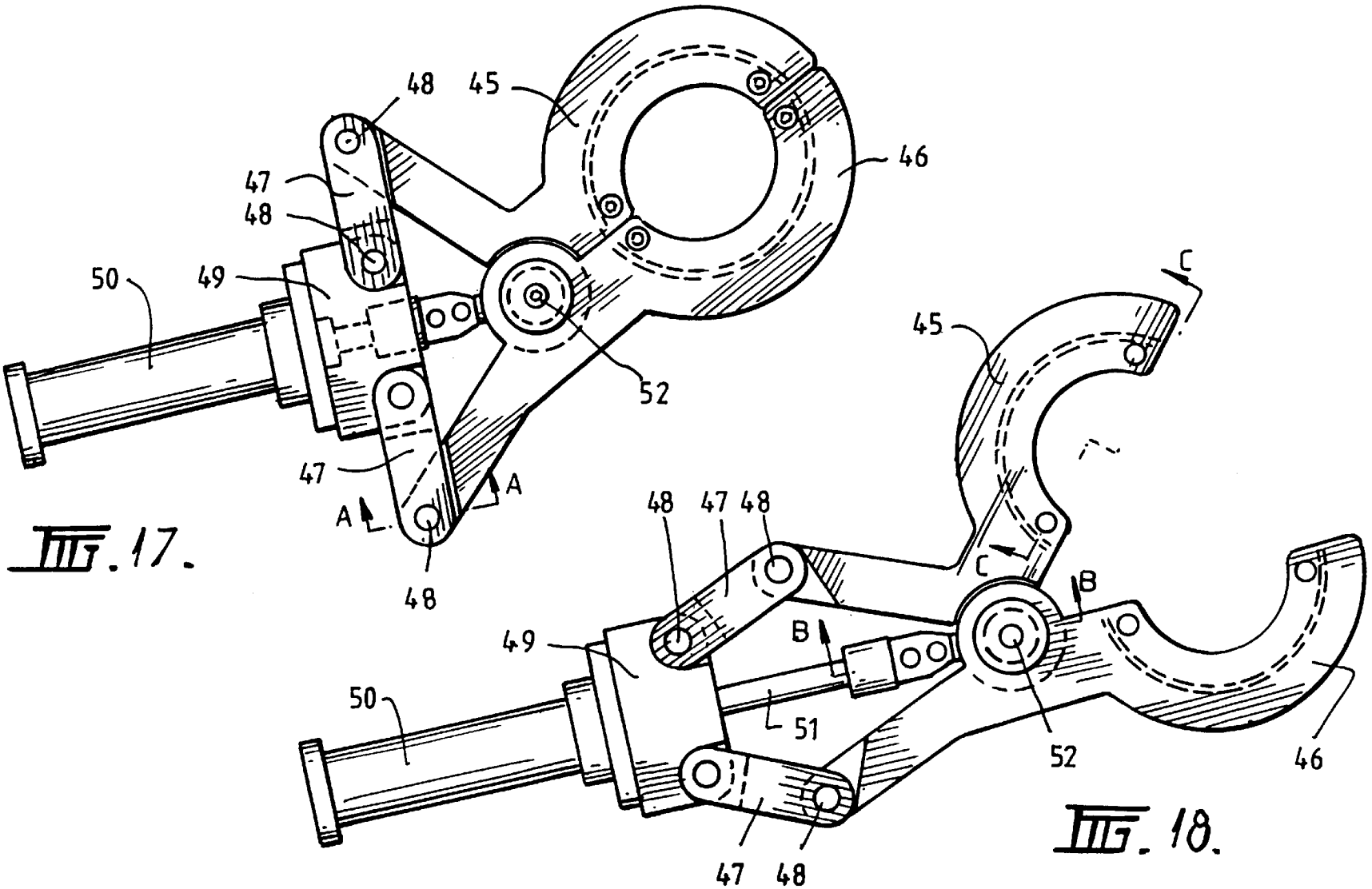
FIG. 17 is an enlarged view of a claw assembly of FIG. 9 in the closed position.
FIG. 18 is an enlarged view of a claw assembly of FIG. 9 in the open position.
Figure 19:
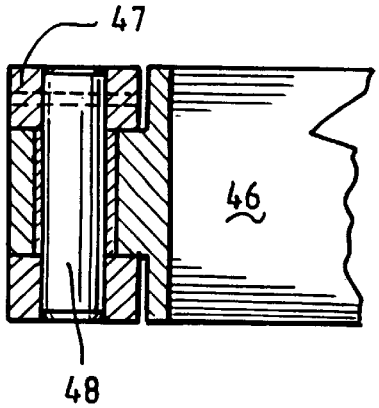
FIG. 19 is a sectional view through line A—A of FIG. 17.
Figure 20:
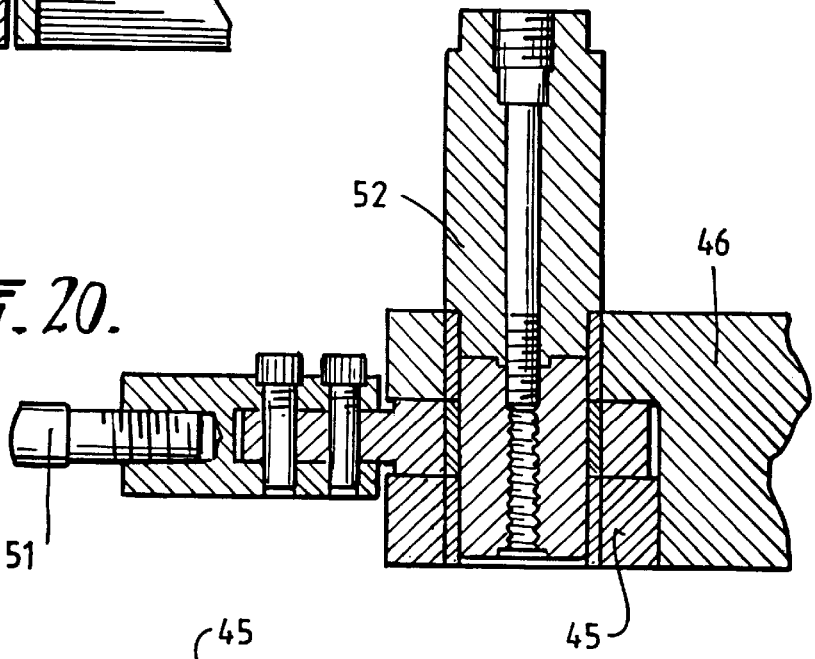
FIG. 20 is a sectional view through line B—B of FIG. 18.
Figure 21:
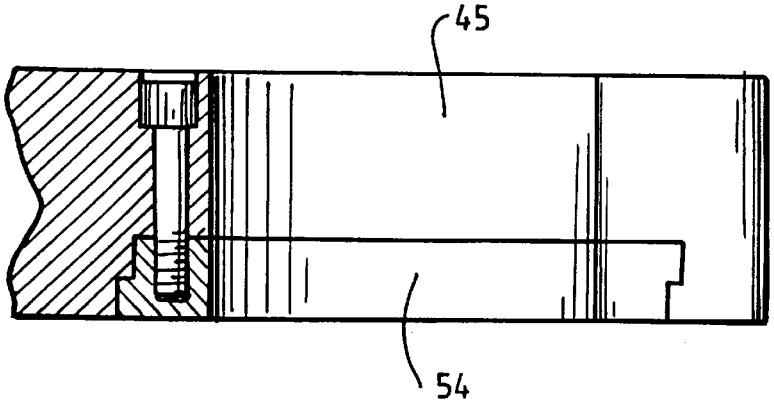
FIG. 21 is a sectional view through line C—C of FIG. 18.
Figure 23:
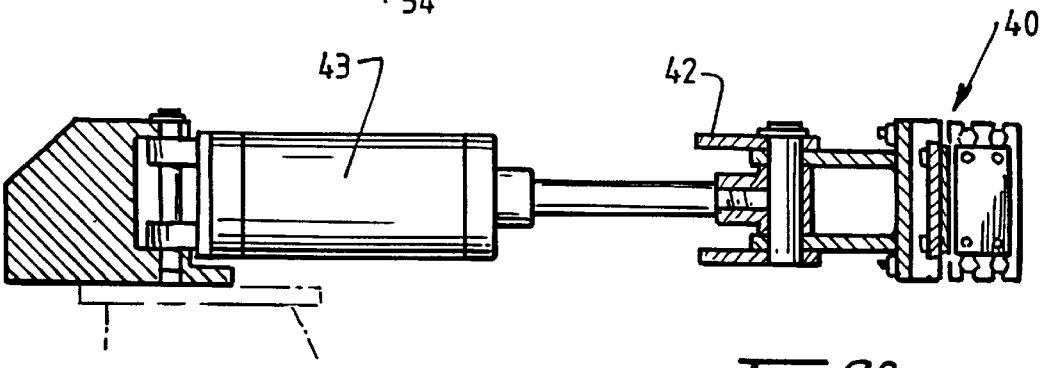
FIG. 23 is a section view through line A—A of FIG. 22.

As shown in FIGS. 14, 15 and 16, the clamp assembly which is sandwiched between the fixed plate 23 and a bottom plate 29 consists of a central rod 30 actuated by a pneumatic cylinder 34 at the rear of the clamp assembly which, when extended, acts on cam surfaces 31 of clamp 32. The clamps 32, pivot around a clamp pivot shaft 28 to clamp or grab the stub. A sandwich plate 33 maintains the distance between the fixed plate 23 and the bottom plate 29 and is recessed to house the clamp mechanism between the fixed plate 23 and bottom plate 29.

When using the clamp mechanism, the clamps 32 clamp the stub 12 of the anode above the thimble 13. During the butt breaking and thimble stripping operation, the thimbles abut directly against the underside of the clamps of the fixed plate assembly 21. As a result of the close proximity of the clamps to the fixed plate 23, the load which is applied by the hydraulic ram assembly 15 is transferred to the fixed plate through the thimbles 13 and clamps 32.

Since the clamps are much wider than the thimble flanges 16 and the clamps surround a large proportion of the anode stub, a much larger surface is provided to transfer the loads through the thimbles to the fixed plate via the clamps.

An alternative stub locating mechanism shown in FIGS. 7, 17, 18, 19, 20 and 21 uses a claw design which allows for stub variations and provides a close fit around the stub in any location. The claw arms 45, 46 simply open and close around the stub 12 above the thimble 13. Claw linkages 47 which are pivotally attached to claw arms 45, 46 are pivotally attached at pivots 48 to pneumatic cylinder housing 49. The claw arms 45, 46 are actuated bya pneumatic cylinder 50 within housing 49 which drives an actuation rod 51 mounted behind pivotal connection pins 52 connecting claw arms 45, 46. The claws 45, 46 are normally held open against the walls of the sandwich plate 53 which may be formed in segments to house the claw mechanism between the fixed plate and bottom plate and on actuation by retracting rod 51 the claws 45, 46 close, self centering about the stub 12. The bottom plate 29 is mounted on the fixed plate 23 to retain the claw assembly and a sandwich plate in position. During and after butt crushing, the anode bar is raised so that the top of the thimble flanges 16 rest against the underside of the claws of claw arms 45, 46. The underside of the claw arms 45, 46 may be provided with a rebate 54 to seat the flange of the thimble to be stripped.

In respect of both designs, since the stub locating mechanisms are mounted directly under and against the fixed plate 23 substantially all of the load provided by the hydraulic ram is still transferred to the fixed plate 23 of the fixed plate assembly as discussed in an earlier paragraph.

The support frame 20 of the apparatus shown in FIG. 5 is essentially a gussetted fabricated structure in the shape of a C section consisting of a press frame floor base 55 and two side frames 56, 57. The support frame is mounted on a base frame 58 which is fixed to the floor of the rodding room.

To remove the butt ad thimble from the anode in accordance with the invention, the anode is transferred by the conveyor into the position shown in FIG. 5. The anode butt is then raised so that the anode stubs 12 pass through the recesses 24*a* in the plate 23 as shown in FIG. 8 with the thimble flanges 16 against the bottom of the fixed plate assembly. If no stub locating mechanism is provided, the flanges 16 of the thimbles bear against the fixed plate 23.

The hydraulic ram 22 is then raised so that the stripping means contact and penetrate the anode carbon butt 15 to a sufficient depth to fracture the butt 15. The carbon block has a nominal compressive strength of 35 MPa and it is assumed that the carbon block will fail at the compressive stress limit in a brittle (or exploding) manner. As the compressive strength of the carbon block is dependant on the thickness and nature of the carbon, these limits should be determined and allowances to the design made in accordance with the circumstances prevailing. It is also assumed that the rock bits 25 will indent into the carbon block up to the full diameter of the rock bits main shaft although this may vary depending on the butt depth. The applicants estimate that a load of up to 200 tonnes will be required for four rock bits to crush a carbon block. This estimate incorporates a safety factor of 1.5 since the nominal carbon block strength may also vary.

The hydraulic ram 22 is then retracted to allow the anode butt pieces to fall away from the thimbles 13 onto the shedder plate 27 which guides the carbon pieces to conveyors 59,60 to be conveyed away from the apparatus by conveyors 28. Once the pieces of anode butt have been cleared, if the thimbles have not been stripped from the stubs, the ram is then raised to contact and strip the thimbles on the yoke stubs.

Based on a series of tests, the applicants have found that, in situations where the thimble has not been fused to the yoke stubs, the maximum load required to strip a thimble is up to approximately 150 tonnes. Consequently for a four stub carbon block and yoke assembly, the hydraulic ram 22 must provide a load of up to 600 tonnes to simultaneously strip the four thimbles from their stubs.

The thimble metal then is directed by the shedder plate into conveyors 28 to be carried away from the apparatus.

As clearly illustrated, in order to break the anode butt and strip the thimble, it is necessary for substantially all of the load to be transferred to the fixed plate 23 during the breaking and stripping operation so that the fixed plate acts as anvil against the force applied by the hydraulic ram.

Once the thimble has been stripped the yoke is removed from the apparatus.

Those skilled in the art will appreciate that the invention described herein is susceptible to variations and modifications other than those specifically disclosed. It is to be understood that the invention is considered to encompass all such variations and modifications that are all within its spirit and scope.

I claim:

1. An apparatus for breaking the anode butt and stripping the thimbles from the stubs of an anode, the stubs being connected to an anode rod by a yoke, including a support frame, a fixed plate assembly substantially secured to said support frame and a ram assembly extendible towards said fixed plate assembly for contacting and breaking the anode butt and stripping the thimbles, said fixed plate assembly comprising a substantially rigid fixed plate having recess to receive the anode stubs and yoke of said anode, the thimbles on the stubs of the anode abutting against said fixed plate assembly during the extension of said ram assembly to contact and break the anode butt.

2. The apparatus according to claim 1 wherein the ram assembly includes an hydraulic ram and a stripping means, said hydraulic ram being extendible towards said fixed plate assembly.

3. The apparatus according to claim 2 wherein the stripping means include rock bits mounted on a platen attached to the ram.

4. The apparatus according to claim 3 wherein the number of rock bits mounted on said platen is equivalent to the number of thimbles to be stripped from the stubs of the anode.

5. The apparatus according to claim 3 wherein said ram assembly further includes a shedder plate mounted on said platen, said rock bits of said platen protruding through apertures in said shedder plate.

6. The apparatus according to claim 5 wherein said shedder plate deflects pieces of anode butt and split thimble broken during the action of the ram assembly to either side of said ram assembly.

7. The apparatus according to claim 6 wherein a conveyor means is provided cooperating with said shedder plate to convey pieces of anode butt and split thimble from the ram assembly.

8. The apparatus according to claim 1 wherein said thimbles on the stubs of said anode abut against said substantially rigid fixed plate of said fixed plate assembly during the extension of said ram assembly on the anode butt.

9. The apparatus according to claim 1 wherein said fixed plate assembly further includes a stub locating mechanism to secure the stubs of the anode in position relative to the fixed plate.

10. The apparatus according to claim 9 wherein the stub locating mechanism includes a claw assembly having claws adjacent said rigid fixed plate for receiving and locating a stub in position relative to said fixed plate.

11. The apparatus according to claim 10 wherein during the extension of said ram assembly on the anode butt and thimbles, said thimbles on the stubs of the anode abut against said claws, said claws abutting and being supported by the substantially rigid fixed plate.

12. The apparatus according to claim 9 wherein the stub locating mechanism includes a claw assembly having clamp jaws adjacent said substantially rigid fixed plate for receiving and locating a stub in position relative to said fixed plate.

13. The apparatus according to claim 12 wherein during the action of said ram assembly on the anode butt and thimbles said thimbles abut against said clamp jaws, said clamp jaws abutting and being supported by said substantially rigid fixed plate.

14. The apparatus according to claim 1 further including a locating means to align the anode stubs with the recesses in substantially rigid fixed plate.

15. The apparatus according to claim 1 wherein said locating means includes a pair of articulated arms which position the anode butt between the ram assembly and the fixed plate assembly and aligns the anode stubs with the recesses in the substantially rigid fixed plate.

16. The apparatus according to claim 1 wherein said fixed plate assembly is positioned above said ram assembly, said ram assembly extending upwardly for contacting and breaking the anode butt and strip the thimble.

17. The apparatus according to claim 1 wherein the substantially rigid fixed plate is provided with an aperture which separates the fixed plate into two sections to allow the movement to position the anode butt and remove the stripped stubs to be carried out in a single direction.

18. An apparatus for removing the anode butt and thimbles from the stubs of an anode including:

a support frame, a fixed plate assembly substantially secured to said support frame, including a substantially rigid fixed plate having recesses to receive the anode stubs of said anode, a ram assembly extendible towards said fixed plate assembly for contacting and breaking the anode butt and stripping the thimbles, and a locating means for positioning and aligning said anode between said ram assembly and said fixed plate, said thimbles on the stubs of the anodes being prevented from passing through the recesses in the substantially rigid fixed plate during the extension of said ram assembly to break the anode butt and strip the thimbles.

19. The apparatus according to claim 18 wherein the recesses in the substantially rigid fixed plate are of a size to enable the stubs of the anode to pass therethrough and cause the thimbles on the stubs of the anode to abut the substantially rigid fixed plate during the extension of said ram assembly.

20. The apparatus of claim 18 wherein the fixed plate assembly further includes a stub locating mechanism adjacent said substantially rigid plate to locate the stubs of the anode in the recesses of the substantially rigid fixed plate.

21. The apparatus of claim 20 wherein the thimbles on the stubs of the anode abut the stub locating mechanism during the extension of said ram assembly, the stub locating mechanism abutting and being supported by the substantially rigid fixed plate.

22. The apparatus of claim 18 wherein the ram assembly includes an hydraulic ram extendible towards said fixed plate assembly and a stripping means for contacting and breaking said anode butt and stripping said thimbles on the stubs of the anode.

23. The apparatus of claim 22 wherein the stripping means includes rock bits mounted on a platen attached to the ram, the number of rock bits being equivalent to at least the number of thimbles to be stripped from the stubs of the anode.

24. The apparatus of claim 23 wherein the ram assembly further includes a shedder plate mounted on said platen, said rock bits of said platen protruding through apertures in said shedder plate.

25. The apparatus of claim 24 wherein the shedder plate deflects pieces of anode butt and split thimbles broken during the extension of the ram assembly to a conveyor means to convey pieces of anode butt and thimble from the ram assembly.

26. The apparatus of claim 18 wherein said fixed plate assembly is positioned above said ram assembly, said ram assembly extending upwardly for contacting and breaking the anode butt and stripping the thimbles.

27. A method for the removal of an anode butt and thimbles from the stubs of an anode including the steps of positioning the anode butt between a fixed plate assembly and a ram assembly for contacting and breaking said anode butt, said fixed plate assembly having a substantially rigid fixed plate, aligning the anode stubs with recesses in the substantially rigid fixed plate, moving the anode butt towards the substantially rigid fixed plate to receive the anode stubs within the recesses in the rigid fixed plate and abutting the thimbles against the fixed plate assembly, extending the ram assembly towards the substantially rigid fixed plate to contact and break said anode butt against the fixed plate assembly and strip the thimbles from the anode stubs, retracting the ram assembly and withdrawing the stripped anode stubs from the fixed plate assembly.

28. The method according to claim 27 wherein the step of extending the ram assembly to break the anode butt and strip the thimbles includes the steps of extending the ram assembly to break the anode butt, retracting the ram assembly to allow the larger pieces of anode butt to be cleared from the stubs of the anode and extending the ram assembly to strip the thimbles and remaining anode pieces from the anode stubs.

29. The method according to claim 27 wherein the fixed plate assembly is provided with a stub locating mechanism, the anode stubs being secured in position relative to said substantially rigid fixed plate by said stub locating mechanism, said thimbles abutting against said stub locating mechanism during the action of the ram assembly on the anode butt and thimbles.

* * * * *